US005322476A

United States Patent [19]

Wortman

[11] Patent Number: 5,322,476

[45] Date of Patent: Jun. 21, 1994

[54] BOWLING ALLEY RECESSED RAIL DEFLECTOR

[76] Inventor: Alex Wortman, 1705 Wells, Ann Arbor, Mich. 48104

[21] Appl. No.: 902,379

[22] Filed: Jun. 23, 1992

[51] Int. Cl.[5] ..... A63D 5/00

[52] U.S. Cl. ..... 473/113; 473/55

[58] Field of Search ..... 273/37, 51, 54 R; 473/54, 55, 106, 109, 113

[56] References Cited

U.S. PATENT DOCUMENTS

| | | | |
|---|---|---|---|
| 2,628,103 | 2/1953 | Parmer | 273/126 |
| 3,046,012 | 7/1962 | Marx | 273/51 |
| 3,401,933 | 9/1968 | Conklin | 273/37 |
| 4,330,122 | 5/1982 | Sheinberg | 273/51 |
| 4,420,155 | 12/1983 | Sheinberg | 273/51 |
| 4,900,024 | 2/1990 | Chandler | 273/37 |
| 5,181,716 | 1/1993 | Stephens | 273/54 R |

*Primary Examiner*—Vincent Millin
*Assistant Examiner*—William M. Pierce
*Attorney, Agent, or Firm*—James M. Deimen

[57] ABSTRACT

A new recessed rail deflector or bumper for a bowling alley comprises a rail or bumper that rises vertically adjacent to the edge of the bowling alley lane. The rail or bumper is concealed in a longitudinal pocket or well formed in the gutter with the top of the rail forming a small portion of the gutter surface adjacent to the edge of the lane. The new rail or bumper is totally non-obtrusive when retracted and therefore is harmonious with the gutter and lane and hidden from view. A simple four bar linkage causes the rail or bumper to rise into position to prevent balls from entering the gutter in "bumper bowling".

11 Claims, 2 Drawing Sheets

BOWLING ALLEY RECESSED RAIL DEFLECTOR

BACKGROUND OF THE INVENTION

The field of the invention pertains to the game of bowling, and in particular, to optional means to deflect a bowling ball from entering the gutter adjacent the lane. Such devices have been used to make the game more enjoyable and less frustrating for beginners to the sport, smaller children and those suffering from physical handicap.

One of the earlier attempts to provide a practical deflection means in an alley is disclosed in U.S. Pat. No. 3,401,933 wherein the entire gutter is mounted on a mechanical assembly beneath the gutter. The gutter is hinged at the far side of the gutter from the alley and caused to rotate upwardly into a position whereby the underside of the gutter is exposed. Attached to the gutter underside is a bumper extending the longitudinal length of the gutter at the appropriate position for contact by a bowling ball when the gutter is fully raised.

Another early device is shown in U.S. Pat. No. 2,628,103 wherein a longitudinal bumper is affixed into the gutter of a shuffle-board game alley for a tabletop shuffleboard game. This bumper assembly, however, is relatively fixed in construction, requiring the assembly and disassembly of multiple turnbuckles to install and remove. Therefore the device can not easily be installed or removed in comparison with the raising and lowering of the gutter above described.

Another device, shown in U.S. Pat. No. 3,046,012 causes portions of the bowling alley lane to be raised from below to form a guide trough for the ball just after it is thrown. The guide trough is for helping beginners to learn to properly throw the ball without damaging the alley lane or constantly throwing gutter balls.

A previous patent to the applicant, U.S. Pat. No. 4,330,122 discloses pneumatic plastic tubes that are placed in the gutters and inflated quickly to form cushions or bumpers. The cushions are likewise quickly deflated and rolled up to effect removal. These cushions have proven very successful in the market place, however, with frequent use, the plastic tubes eventually develop pin hole airleaks which are difficult to locate for repair. In addition, some bulky auxiliary equipment is required including an aircompressor cart with means for storing deflated cushions thereon.

A second patent to the applicant, U.S. Pat. No. 4,420,155, discloses in addition to the above, elastic bands stretched longitudinally adjacent the lane and thereabove to form a bumper preventing the ball from entering the gutter.

U.S. Pat. No. 4,900,024 discloses a mechanical bumper that is attached atop the median between the gutters of adjacent alleys. The bumper is extendable and retractable horizontally above the gutter to guard the gutter and expose the gutter respectively. The bumper may be deployed manually or by a motor gear drive assembly at one end of the bumper assembly. The bumper assembly including most mechanical parts is completely exposed above the gutter.

The inflatable cushion described in U.S. Pat. No. 4,330,122 above is the device that has had the most effect in popularizing the concept of utilizing deflection devices in bowling alleys. More than half of the approximately 8000 bowling centers in the United States are now utilizing some form of deflection device for keeping balls out of the gutter.

The newer bumper noted above in U.S. Pat. No. 4,900,024 overcomes some of the disadvantages of the inflatable cushion and is more quickly deployed and retracted. Therefore, this bumper has gained some favor in the market. However, this bumper mechanism is quite expensive to purchase and install, requiring the tearing up of the structure between the gutters of adjacent lanes and reconstruction with the mechanism to actuate the bumper. In addition to the installation expense, many bowlers consider the exposed mechanism to be overly obtrusive and visually displeasing.

With a view toward overcoming the less desirable aspects of the above bumper systems, applicant has developed the new bumper assembly disclosed below.

SUMMARY OF THE INVENTION

The new recessed rail deflector or bumper comprises a mechanically actuated rail or bumper that rises vertically adjacent the edge of the bowling alley lane. The rail is concealed in a longitudinal pocket or well formed in the gutter with the top of the rail forming a small portion of the gutter surface adjacent the edge of the lane. The mechanical assembly comprises a four bar linkage actuateable by manual means or powered means such as a motor reduction gear drive, or pneumatic or hydraulic cylinder means for example.

Thus, the new rail or bumper is totally non-obtrusive when retracted and is harmonious with the gutter rather than adding a obvious device that is distracting to bowlers and detracts from the overall appearance of the bowling alley. The new rail or bumper takes advantage of the ability to relatively inexpensively mold the gutter by extrusion with a small longitudinal well into which the rail retracts.

The new recessed rail deflector takes a new approach to providing a bumper. Rather than place a large object in the gutter (inflatable cushion), swing a bumper horizontally out from another area, or use tremendously expensive equipment to swivel the entire gutter, the new recessed rail rises from a small longitudinal strip of gutter on a simple mechanism. The new recessed rail is ideally suited for retrofit of existing gutters in need of replacement. By recognizing the need for new gutters, the owner or manager of the bowling alley is also pressured by the success of "bumper bowling" to install deflection devices. The new recessed rail deflector and mechanism is integrated into the new gutter and the new gutter merely dropped into place to replace the old gutter.

DESCRIPTION OF THE PREFERRED EMBODIMENTS

Figure 1:
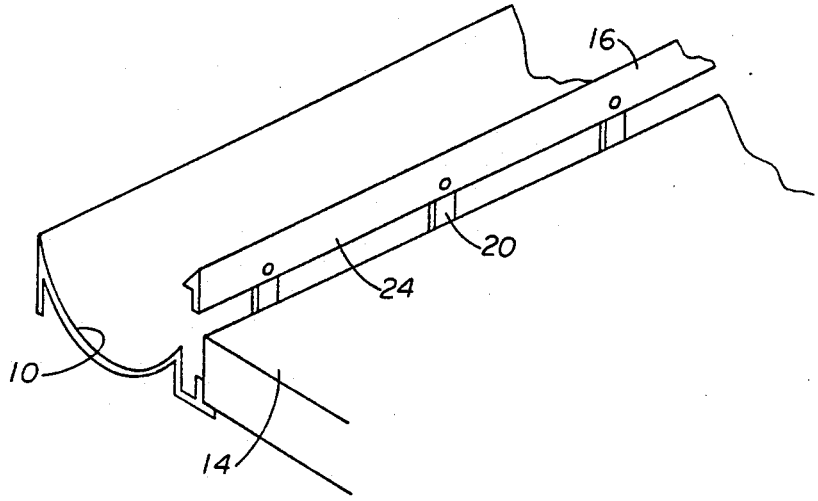
FIG. 1 is a partial perspective view of the bumper of rail in raised position.
Figure 2:
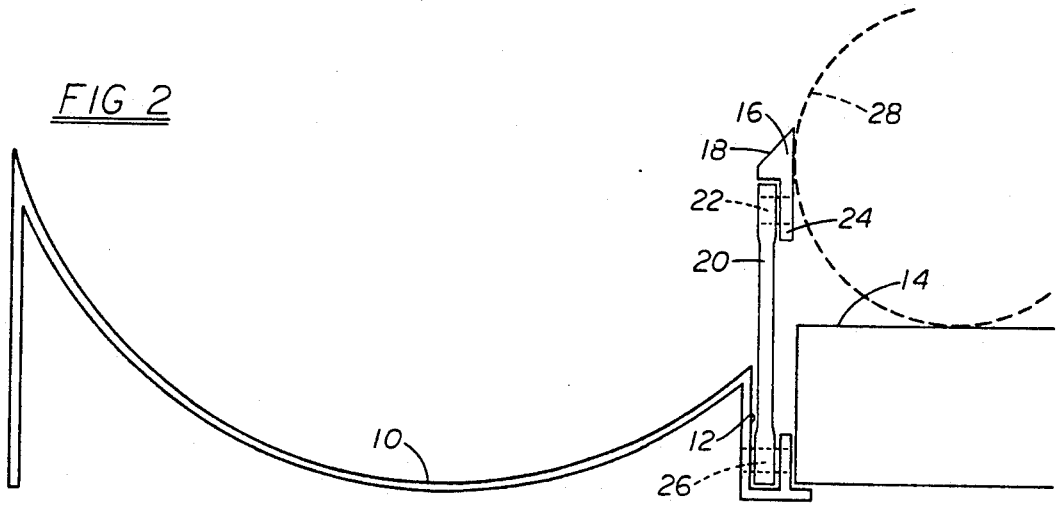
FIG. 2 is a cross-section through the gutter and rail with the rail raised.
Figure 3:
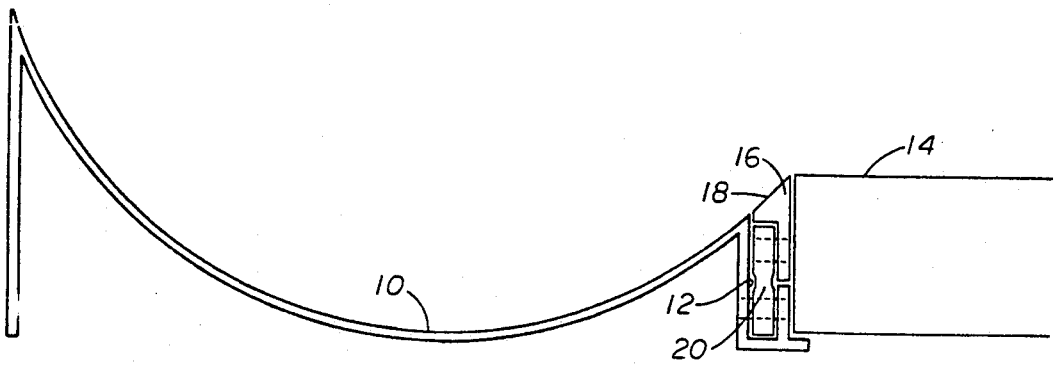
FIG. 3 is a cross-section through the gutter and rail with the rail retracted into the well.

Illustrated in FIGS. 1, 2 and 3 is a bowling alley gutter 10 of extruded plastic having a relatively small well 12 formed as a part of the gutter and substantially rectangular in cross-section. The well 12 lies immediately adjacent the deck 14 of the lane. Substantially within the well 10 is a longitudinal rail or bumper 16 when in retracted position as best shown in FIG. 3. The upper surface 18 of the rail 16 continues and conforms to the concave shape of the gutter thereby covering the well 10 and presenting an unobtrusive appearance to the gutter.

Beneath the top of the rail 16 and supporting the rail are a plurality of parallel links 20 rotatably attached to the rail by pins or shafts at 22. The rail 16 is preferably also of extruded plastic with holes punched in the flange portion 24 of the rail periodically along the length thereof for the pins or shafts at 22. The lower ends of the links 20 are connected rotatably by pins or shafts at 26 to the well 12 sides toward the bottom of the well. Thus, with the well 12 and rail 16 the parallel links 20 form four bar linkages enabling the rail 16 to be raised and lowered vertically along the length of the gutter.

As shown in FIG. 2 the rail 16 is raised an amount sufficient to act as a bumper to a bowling ball 28 thereby preventing the ball from entering the gutter 10. This preferred embodiment is intended for both retrofit installations in bowling alleys as well as new installations. For new installations, as an alternative, the gutter extrusion may be modified by tilting the well 12 partially under the lane 14 thus tilting the rail 16 as extended back toward the gutter 10 an amount sufficient to allow the ball 28 to roll up to the edge of the lane 14.

As a second alternative for new installations and retrofit installations the surface 18 of the rail 16 may be horizontal and level with the lane 14. In the second alternative the gutter 10 may be formed to extend up to the level of the lane 14 adjacent to the well 12.

Figure 4:
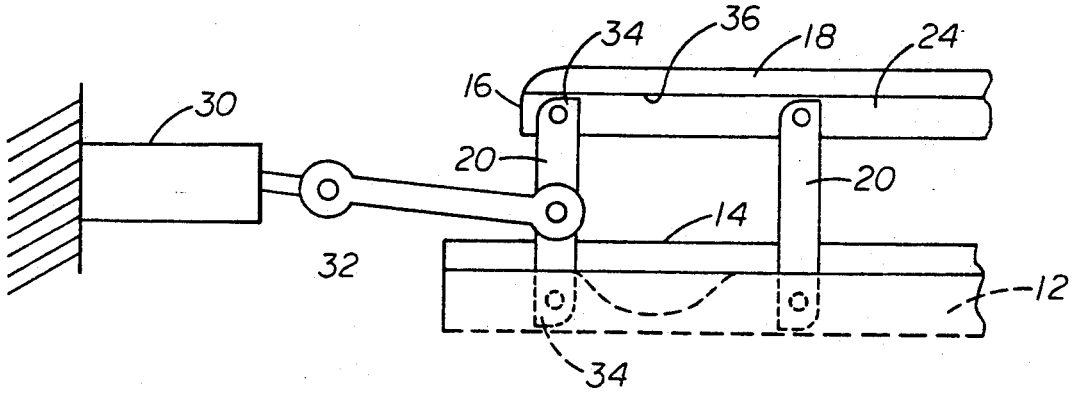
FIG. 4 is a schematic of a cylinder actuator for the new rail.

FIG. 4 illustrates schematically a fluid cylinder 30 having a piston rod attached to a link 32 in turn attached to an end link 20 of the rail 16 assembly. Actuation of the cylinder 30 can thereby raise and lower the rail 16 as desired from a remote location. Other means such as an electric gear motor can also be used. Each of the links 20 is formed with a square corner 34 which prevents the link 20 from moving beyond the vertical up or extended position as shown. The square corner either engages the bottom of the well 12 or the underside 36 of the top portion of the rail 16.

A suitable plastic for the extrusions that is highly impact resistant is nylon 6 such as the black pigmented modified alloy sold as DIMENSION TM D-9303BK from Allied-Signal Corporation, Morristown, N.J. Other substantially tough, impact resistant plastics may be used for the extrusions and the links. Also, in addition to the four bar linkage means of raising and lowering the rail 16 other means of raising and lowering the rail might be employed such as a plurality of small vertically mounted air cylinders or screw operated jacks.

I claim:

1. An extendable and retractable deflector assembly for a bowling alley comprising a longitudinal stationary gutter, a longitudinal pocket formed in the gutter and extending downwardly along an edge of the gutter, a longitudinal rail positioned in the pocket when retracted and extendable substantially vertically into a position to deflect bowling balls from the gutter, and activation means attached to the pocket below the longitudinal rail to extend and retract the rail, whereby said assembly is an integrated unit positionable as a single unit adjacent a bowling alley lane.

2. The deflector of claim 1 wherein the actuation means comprises a plurality of parallel links, each link rotatably connected at one end to the rail and at the other end rotatably connected to the pocket.

3. The deflector of claim 1 wherein the upper surface of the rail comprises a continuation of the surface of the gutter.

4. The deflector of claim 1 wherein the upper surface of the rail comprises a portion of the edge of the lane alongside the gutter.

5. The deflector of claim 1 wherein the stationary gutter and pocket comprise a single integrated plastic extrusion in cross-section.

6. The deflector of claim 1 including powered means connected to the actuation means to extend and retract the rail.

7. An extendable and retractable deflector assembly for a bowling alley comprising a longitudinal stationary gutter, a longitudinal rail positioned along an edge of the gutter such that the rail can be retracted and is extendable substantially vertically into a position to deflect bowling balls from the gutter, means supported by the gutter for operatively supporting the longitudinal rail, said support means extending substantially downwardly from the gutter and secured to the edge of the gutter, and activation means attached to the support means below the longitudinal rail to extend and retract the rail, whereby said assembly is an integrated unit positionable as a single unit adjacent a bowling alley lane.

8. The deflector of claim 7 wherein the actuation means comprises a plurality of parallel links, each link rotatably connected at one end to the rail and at the other end rotatably connected to the support means.

9. The deflector of claim 7 wherein the upper surface of the rail comprises a continuation of the surface of the gutter.

10. The deflector of claim 7 wherein the upper surface of the rail comprises a portion of the edge of the lane alongside the gutter.

11. The deflector of claim 7 including powered means connected to the actuation means to extend and retract the rail.

* * * * *